US009079705B2

(12) United States Patent
Digiuni

(10) Patent No.: US 9,079,705 B2
(45) Date of Patent: Jul. 14, 2015

(54) CAPSULE FOR MAKING BEVERAGES

(75) Inventor: Paolo Digiuni, Montagnola (CH)

(73) Assignee: Caffitaly System S.p.A., Gaggio Montano (Bologna) (IT)

( * ) Notice: Subject to any disclaimer, the term of this patent is extended or adjusted under 35 U.S.C. 154(b) by 267 days.

(21) Appl. No.: 13/549,904

(22) Filed: Jul. 16, 2012

(65) Prior Publication Data

US 2014/0010926 A1 Jan. 9, 2014

(30) Foreign Application Priority Data

Jul. 3, 2012 (IT) ..... VR2012A0133

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
USPC ..... 210/464, 469, 474, 477
See application file for complete search history.

(56) References Cited

U.S. PATENT DOCUMENTS

2002/0020659 A1* 2/2002 Sweeney et al. ..... 210/416.3
2005/0051478 A1 3/2005 Karanikos et al.

OTHER PUBLICATIONS

Paper Souffle Portion Cups, SOLO Cup Company catalogue, Mar. 9, 2006.*
Italian Search Report in reference to Italian Patent Application No. ITVR20120133 dated Jul. 3, 2012 ( 8 pages).

* cited by examiner

*Primary Examiner* — Rena L Dye
*Assistant Examiner* — Chaim Smith
(74) *Attorney, Agent, or Firm* — Maginot, Moore & Beck, LLP

(57) ABSTRACT

A capsule (1) for making beverages comprises a powdered food substance, and comprises a body (2) having a lower wall (3) and a side wall (4), and a lid (6) fixed to an edge (5) of the side wall (4). Between the lid (6) and the inner surface of the body (2) there is a chamber in which a rigid or semi-rigid filter (10) is positioned, coupled at a coupling portion (14) located on the side wall (4) close to the edge (5). The filter (10) extends between a rim (12) positioned close to the lid (6) and coupled to the coupling portion (14), and a bottom portion (13) positioned close to the lower wall (3), and separates the chamber into a first compartment (15), containing the substance, delimited at least between the filter (10) and the lid (6), and into a second compartment (16) partly positioned between the side wall (4) and the filter (10), delimited between the filter (10), the lower wall (3) and the portion of side wall (4) located between the lower wall (3) and the coupling portion (14). The second compartment (16) comprises openings (11) at the part of it positioned between the filter (10) and the side wall (4).

19 Claims, 3 Drawing Sheets

CAPSULE FOR MAKING BEVERAGES

BACKGROUND

This invention relates to a capsule for making beverages. In particular reference is made to those capsules comprising a body and a lid which closes the top of the body and in which a powdered food substance (for example coffee powder) is positioned, which can be extracted by passing water (which may be pressurised) through it to make a beverage, for example coffee. More specifically reference is made to those capsules in which the body comprises a lower wall and a side wall which form a chamber in which a rigid or semi-rigid filter is positioned.

In more detail, reference is made to those capsules suitable for use in beverage making systems in which the capsule is pierced at the lid, to allow the injection of water (which may be pressurised) into the capsule itself, and at the lower wall, to allow dispensing outside the capsule of the beverage produced by the interaction of the water with the powdered food substance.

In such capsules the filter is substantially a flat filter, normally disk-shaped, positioned close to the lower wall of the capsule body and separates the powdered food substance from the lower wall in such a way that powder does not come out of the capsule after a piercing element has penetrated through the lower wall. In fact, the filter comprises openings which allow the beverage to pass through it in such a way that said beverage can come out of the capsule through the lower wall (through the hole made by the piercing element or through a channel present in the latter). However, at the same time the openings allow the powdered food substance to be retained.

However, this prior art technology may have several disadvantages under certain circumstances.

In particular, with some types and particle sizes of the powdered food substance the prior art capsules may not allow optimum extraction of the powdered food substance. In fact, for example, the beverage made by the interaction between the water and the powder located close to the lid, in order to be able to come out of the capsule must reach the filter and therefore must pass through all of the powder below which may obstruct its path. In fact, once moistened with the water, the powdered food substance tends to become compacted, obstructing the flow of the liquids which encounter increased resistance to permeation through the powder.

In fact, the water injected into the capsule tends to draw the powdered food substance with it, carrying it towards the filter and causing it to build up and become compacted precisely at the filter, therefore increasing the resistance of the powdered food substance to the passage of liquids through it and resulting in difficulties draining the beverage through it.

Therefore, during the injection of water into the capsule, areas are created in the powder which are compacted to different degrees. Therefore, prior art capsules have the disadvantage that the powdered food substance can only be permeated unevenly, that is to say, to drastically different degrees depending on the position of the powdered food substance in the capsule. Moreover, in prior art capsules, since the water tends to flow in the zones of the powder which are less resistant to permeation, preferential channels for the passage of the water are easily created, the result being that the powdered food substance is not all permeated homogeneously.

SUMMARY OF THE INVENTION

In this context, the technical purpose which forms the basis of this invention is to provide a capsule for making beverages which overcomes the above-mentioned disadvantages.

In particular, the technical purpose of this invention is to provide a capsule for making beverages which allows the water fed in to permeate the powdered food substance more evenly than the prior art capsules.

It is also the technical purpose of this invention to provide a capsule for making beverages which allows limitation, compared with prior art capsules, of the risk of forming highly compacted zones, in the powdered food substance, which could obstruct the flow of the beverage.

This invention also has for a technical purpose to provide a capsule for making beverages which, compared with prior art capsules, promotes water permeation through the entire powdered food substance, limiting the risk of forming in the latter preferential channels for the passage of the water.

The technical purpose specified and the aims indicated are substantially achieved by a capsule for making beverages as described in the appended claims.

BRIEF DESCRIPTION OF THE DRAWINGS

Further features and advantages of this invention are more apparent in the detailed description below, with reference to a preferred, non-limiting embodiment of a capsule for making beverages, illustrated in the accompanying drawings, in which.

DETAILED DESCRIPTION

Figure 1:
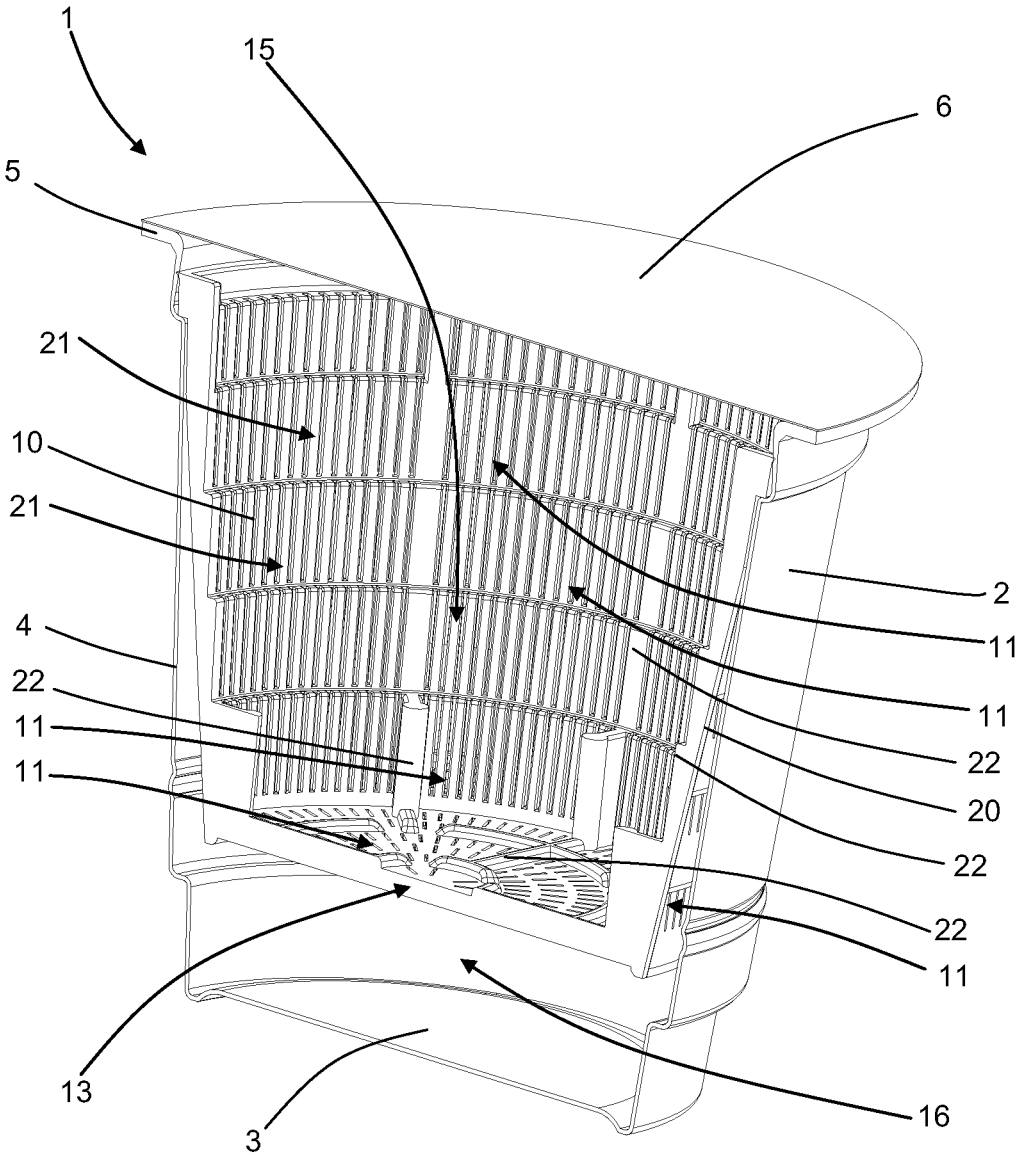
FIG. 1 is an axonometric top view of a capsule according to this invention, cut according to a first vertical cutting plane passing through an axis of extension of it.

With reference to the accompanying drawings, the numeral 1 denotes in its entirety a capsule for making beverages in accordance with this invention.

This invention relates to a capsule 1 for making beverages comprising at least one powdered food substance which can be extracted by passing water through it to make a beverage. The powdered food substance, for example powdered coffee, can be extracted for example by infusion or is soluble to make a beverage such as coffee or tea, infusions, soups, etc. The capsule 1 may be suitable for allowing extraction of the powdered food substance, such as coffee, by passing pressurised water through it, for example to make an espresso coffee.

The capsule 1 comprises a substantially cup-shaped body 2 which in turn comprises a lower wall 3 and a side wall 4. In the embodiment illustrated the lower wall 3 of the capsule 1 mainly extends in a circular fashion and the side wall 4 extends from it with a shape that to a first approximation is frusto-conical, the upper part of it ending with an edge 5 located on the opposite side to the lower wall 3. A lid 6 is fixed to the body 2 at the edge 5 and closes the top of the capsule 1 body 2. The body 2 and the lid 6 of the capsule 1 may each be made of different materials. The body 2 may, for example, be made of a plastic material whilst the lid 6 may be made of an aluminium sheet. Between the lid 6 and the inner surface of the body 2 there is a chamber. During use of the capsule 1, the beverage is made in the chamber after interaction between the powdered food substance and the water. Between a central point of the lid 6 and a central point of the lower wall 3 is identified an axis of extension 7 of the capsule 1, visible in FIG. 2. In the embodiment illustrated the capsule 1 is symmetrical relative to the axis of extension 7.

Advantageously, in the embodiment illustrated, the lid 6 can be pierced to allow water to be injected into the capsule 1 and the lower wall 3 can also be pierced to allow the beverage to come out of the capsule 1. Therefore, hereinafter reference will preferably be made to this embodiment.

Figure 2:
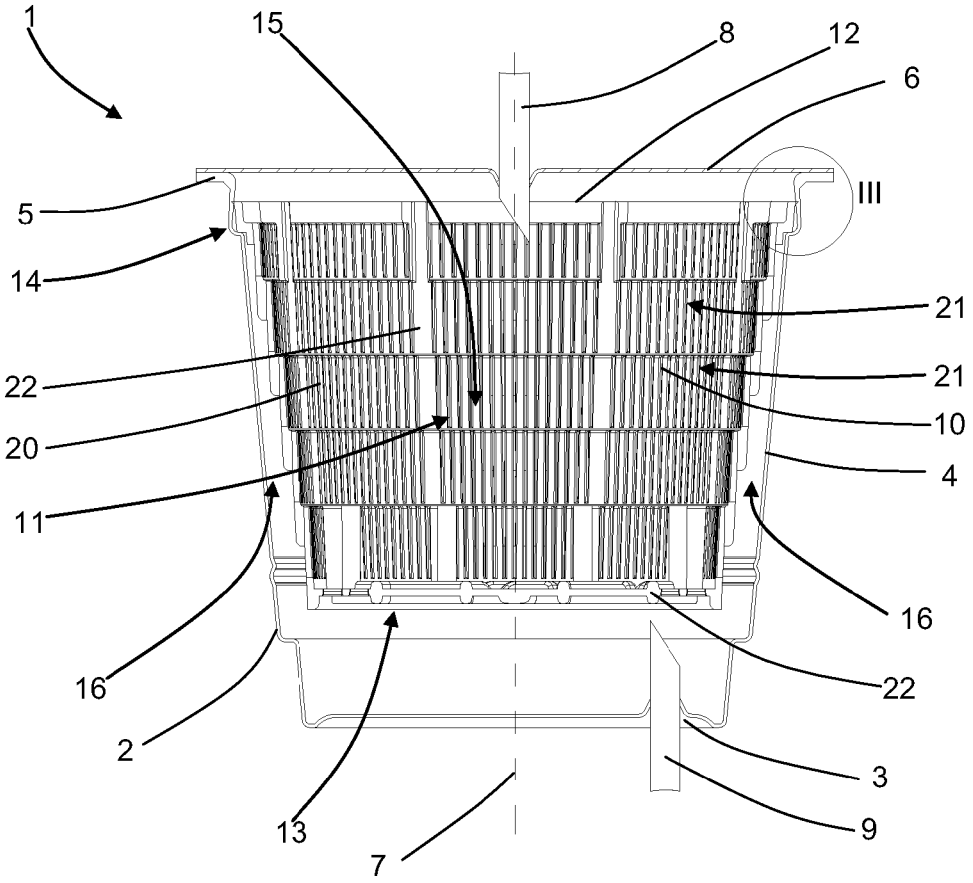
FIG. 2 is a vertical cross-section of the capsule of FIG. 1, according to a second vertical plane passing through the axis of extension and rotated by 22.5° compared with the first cutting plane; it also illustrates an injecting element and a piercing element which respectively pass through the lid and the lower wall.

The capsule 1 is therefore suitable for use in a beverage making system which advantageously comprises a housing in which the capsule 1 can be inserted for use for making a beverage, for example coffee. As shown in FIG. 2, a system suitable for using the capsule 1 illustrated comprises, in the substantially known way, means for injecting water into the capsule 1, which can be associated with the lid 6, comprising an injecting element 8 such as a needle or a blade comprising a channel for the passage of the water, and it also comprises means for extracting the beverage from the capsule 1, which can be associated with the lower wall 3, said means in turn comprising a piercing element 9 for piercing/penetrating the lower wall 3 of the capsule 1 body 2. In this context, the term piercing element 9 refers to any element, substantially of the known type, able to pierce, cut or tear, for example a spike or a blade, fixed or mobile.

The capsule 1 also comprises a rigid or semi-rigid filter 10 positioned in the chamber. That filter 10, in particular, comprises openings 11 for allowing fluid communication through it. The openings 11 are in fact advantageously able to allow the passage of beverages through them and at the same time to substantially retain the powdered food substance so that, during use of the capsule 1, the beverage can pass through the filter 10 and then come out of the capsule 1 (for example through a hole made by the piercing element 9 in the lower 3 or through a channel made in the piercing element 9) and the powdered food substance can remain substantially trapped inside.

According to this invention, the filter 10 extends between a substantially annular rim 12 of the filter located at the top of the filter 10 and positioned close to the capsule 1 lid 6, and a bottom portion 13 located at the bottom of the filter 10 and positioned close to the lower wall 3.

The filter 10 is coupled to the capsule 1 body 2 at a coupling portion 14 with substantially annular extension about the axis of extension 7 and located on the side wall 4.

According to this invention, the coupling portion 14 is located close to the edge 5 of the side wall 4 and the filter 10 is coupled to the coupling portion 14 substantially at the rim 12. Therefore, advantageously the rim 12 of the filter 10 also has substantially annular extension about the axis of extension 7. The coupling between the filter 10 and the capsule 1 body 2 is described in more detail below.

In accordance with this invention the filter 10 substantially separates the chamber into a first compartment 15 in which the powered food substance is contained and a second compartment 16. In the preferred embodiment the piercing element 9, during use, can be inserted in the second compartment 16 without damaging the filter 10, after penetrating through the lower wall 3.

The water injected into the capsule 1 passes through the powdered food substance contained in the first compartment 15. Advantageously, as shown in the accompanying drawings, the rim 12 of the filter 10 substantially delimits an access aperture to the first compartment 15 which in the embodiment illustrated is substantially circular. Therefore, the filter 10 is advantageously open at the top, that is to say, on the side facing towards the lid 6. That embodiment has two advantages: first, during capsule 1 production, when the lid 6 is separate from the body 2, the powdered food substance can be inserted in the first compartment 15 by simply pouring it into said compartment through the access aperture. Second, as shown in FIG. 2, during use of the capsule 1 the injecting element 8 may advantageously pass through the lid 6 and be partly inserted in the first compartment 15 through the access aperture for injecting the water directly into it.

Therefore, in the first compartment 15 the powered food substance interacts with the water injected into the capsule 1 to make the beverage. In contrast, the second compartment 16 is intended, during use, to receive the beverage made in the first compartment 15 and which comes out of the latter through the openings 11 present in the filter 10.

In accordance with this invention, the first compartment 15 is delimited at least between the filter 10 and the lid 6; however, the first compartment 15 may also be delimited by a small annular portion of side wall 4 located between the edge 5 of the side wall 4 itself and the coupling portion 14 (which, as indicated, is close to the edge 5). The first compartment 15 is at least mainly configured as a cavity, delimited by the filter 10, which advantageously extends over most of the volume of the chamber and in which the powdered food substance is positioned.

Also according to this invention, the second compartment 16 is delimited between the filter 10, the lower wall 3 and the portion of side wall 4 located between the lower wall 3 and the coupling portion 14. Moreover, at least part of the second compartment 16 is positioned between the side wall 4 and the filter 10. In other words, the second compartment 16 surrounds at least part of the filter 10. In particular, the second compartment 16 extends along the side wall 4 at least for most of the distance, measured parallel with the axis of extension 7, between the coupling portion 14 and the lower wall 3. In other words, the second compartment 16 surrounds the filter 10 for most of its extension assessed parallel with the axis of extension 7. According to this invention, the openings 11 are made at least at the part of the second compartment 16 positioned between the filter 10 and the side wall 4. In this way, the openings 11 made in the part of the second compartment 16 positioned between the filter 10 and the side wall 4 allow a reduction, compared with prior art capsules, in the average distance that the water must cover through the powdered food substance in order to be able to come out of the filter 10 (or out of the first compartment 15) in the form of the beverage, with the advantage that the water encounters less resistance to its passage through the substance. Consequently, the filter 10 allows improved filtering of the beverage, a reduced tendency of the powdered food substance to become unevenly compacted and therefore more even permeation of the powdered food substance by the water injected into the capsule 1.

However, advantageously, the openings 11 are also made at the bottom portion 13, thereby increasing the possibility of the beverage coming out of the first compartment and further improving filtering of the beverage. Even more advantageously, as in the embodiments illustrated in the accompanying drawings, the second compartment 16 extends along the side wall 4 to the coupling portion 14. Since the filter 10 is coupled to the coupling portion 14 at the rim 12, the substantial totality of the filter 10 is surrounded by the second compartment 16. Advantageously, the openings 11 are distributed over the entire surface of the filter 10 surrounded by the second compartment 16, and in particular over the entire surface of the filter 10 which is at the portion of the second compartment 16 located between the filter 10 and the side wall 4. In the embodiment illustrated, advantageously, the openings 11 are evenly distributed around the filter and are grouped together in groups which are in turn substantially distributed in an even way along the extension of the filter 10 between the rim 12 and the bottom portion 13.

As already indicated, the filter 10 is coupled to the side wall 4 at the coupling portion 14. The coupling may be made in various ways.

Figure 3:
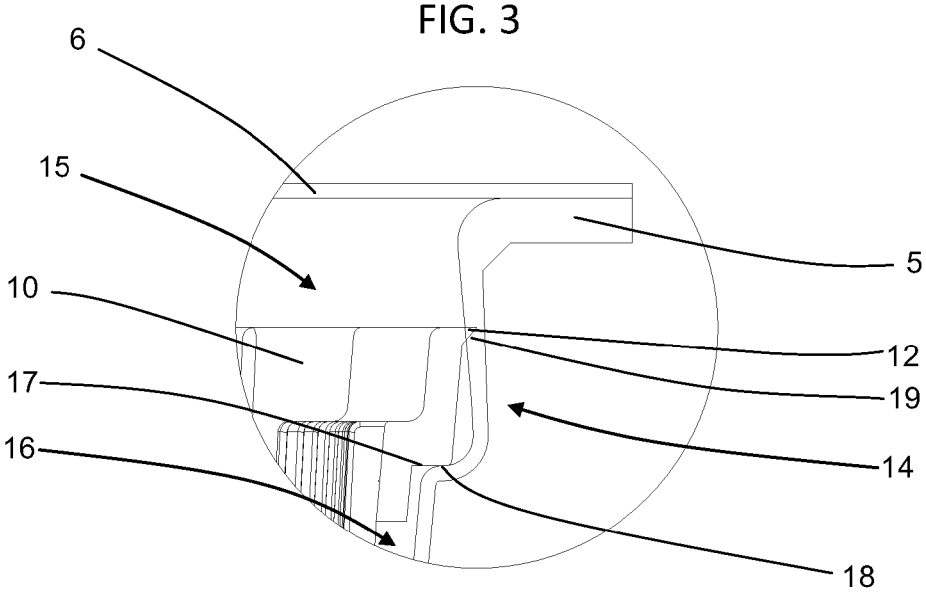
FIG. 3 is a view of the detail III of FIG. 2.

In the preferred embodiment illustrated in the detail in FIG. 3, the filter 10 comprises a shoulder 17, close to the rim 12, with substantially annular extension about the axis of extension 7 and projecting radially relative to the rest of the filter 10, again with reference to the axis of extension 7. In other words, seen in a radial section with reference to the axis of extension 7, the filter 10 comprises a step close to the rim 12. The filter 10 advantageously rests on the coupling portion 14 by means of the shoulder 17. In fact, in the preferred embodiment illustrated, the coupling portion 14 comprises a counter-shoulder 18 which also has substantially annular extension about the axis of extension 7 and which projects radially, with reference to the axis of extension 7, relative to the portion of side wall 4 adjacent to it on the lower wall 3 side. Therefore, as shown in FIG. 3, the shoulder 17 rests on the counter-shoulder 18. In the preferred embodiment illustrated, the rim 12 is coupled to an annular region 19 of the coupling portion 14 which is located between the counter-shoulder 18 and the edge 5 of the side wall 4 to which the lid 6 is fixed (FIG. 3). Therefore, advantageously, in the preferred embodiment, the filter 10 is in contact with the body 2 of the capsule 1, and in particular with the coupling portion 14, substantially at two annular portions, one corresponding to the rim 12 and another corresponding to the shoulder 17. In particular, the contact between the shoulder 17 and the counter-shoulder 18 allows the filter 10, once inserted in the capsule 1 body 2, to stop at the counter-shoulder 18. In other words, the counter-shoulder 18 acts as a contact element which prevents the filter 10 from being subject to further movements towards the lower wall 3 of the capsule 1. That is particularly useful for keeping the filter 10 in a predetermined position, as described in more detail below.

However the coupling is created between the filter 10 and the coupling portion 14, the filter 10 is advantageously coupled to the coupling portion 14 by mechanical interference, and moreover, in addition or alternatively, the filter 10 is coupled to the coupling portion 14, forming a sealed contact with it, where "sealed contact" in this context advantageously refers to a contact which is watertight. Moreover, the sealed contact may also be useful during capsule 1 production. In fact, during insertion of the powdered food substance in the first compartment 15, advantageously the substance being poured through the access aperture as described above, the sealed contact (at the coupling portion 14) allows a guarantee that the powder cannot accidentally be poured into the second compartment 16 (which would compromise use of the capsule 1 for making the beverage).

The coupling which uses mechanical interference and/or is sealed can be made in various ways.

In the preferred embodiment illustrated in the detail in FIG. 3, the mechanical interference coupling is created between the rim 12 of the filter 10 and the above-mentioned annular region 19 of the coupling portion 14. In FIG. 3 the rim 12 is shown interpenetrating with the annular region 19, however that illustration is representative of the design dimensions respectively of the filter 10 and the capsule 1 body 2 and does not reflect the real interaction between said elements which obviously cannot coexist in the same space. In particular, said representation implies that the interference contact between the rim 12 and the annular region 19 in reality, advantageously, requires at least one of these to be in a state of deformation (advantageously elastic).

Mechanical interference is possible thanks to the elastic deformability of the rim 12 and/or of the annular region 19, the elasticity advantageously being allowed by the material used to make them and/or by their shape. In the embodiment illustrated the annular region 19, that is to say, the region of the coupling portion 14 located between the counter-shoulder 18 and the edge 5, is advantageously able to bend. In particular, the annular region 19 presses against the rim 12 of the filter 10 thanks to the elastic deformation to which it is subjected. As shown in FIG. 3, the annular region 19, seen in axial section, extends at an angle relative to the axis of extension 7: in particular proceeding from the edge 5 towards the lower wall 3 the annular region 19 moves away from the axis of extension 7. Moreover, the coupling portion 14 at the edge 5 or at the part of the annular region 19 adjacent to the edge 5, has a cross-section, perpendicularly to the axis of extension 7, which is advantageously less than the area delimited by the rim 12 in the plane perpendicular to the axis of extension 7. Advantageously, for that reason, during capsule 1 production the coupling portion 14, and in particular in the preferred embodiment its annular region 19, resists the passage of the rim 12 during the end step of filter 10 insertion in the chamber. Filter 10 insertion in the chamber therefore requires pressure to be applied on the filter 10, directed towards the lower wall 3, at least as the rim 12 passes at the annular region 19. In the preferred embodiment illustrated, advantageously, the pressure on the filter 10 is maintained until the shoulder 17 is resting against the counter-shoulder 18, thus creating a snap-on type insertion. That particular shape of the coupling portion 14 and its interaction with the filter 10, and in particular with the rim 12, advantageously prevents removal of the filter 10 from inside the capsule 1 body 2, for example after a thrust applied on the bottom portion 13 of the filter 10 and directed towards the lid 6.

Moreover, advantageously, the sealed contact is also created between the rim 12 of the filter 10 and the annular region 19 of the coupling portion 14. In particular, in the embodiment illustrated, the rim 12 and the annular region 19 are made in such a way that between them there is continuous contact, and the seal is guaranteed by mechanical interference.

The filter 10 may come in various shapes. For example, in the preferred embodiment illustrated, the filter 10 is substantially cup-shaped and comprises a side portion 20 extending about the axis of extension 7 between the bottom portion 13 and the rim 12. The openings 11 are located at least on the side portion 20, but advantageously they are also located on the bottom portion 13. The filter 10 substantially determines the shape of the first compartment 15, whilst the shape of the second compartment 16 is determined by the filter 10 together with the capsule 1 body 2. As already indicated, the second compartment 16 is advantageously made in such a way that the piercing element 9 can penetrate through the bottom wall 3 of the capsule 1 without damaging the filter 10. The piercing element 9 can pass through the lower wall 3 of the capsule 1 centrally or off-centre as shown in FIG. 2.

To avoid contact with the piercing element 9 as it penetrates into the second compartment 16 (if the lower wall 3 can be pierced), the filter 10 will advantageously have a shape that allows the piercing element 9 to enter but at the same time avoids contact with it, considering its dimensions, the related stroke and its positioning.

For example, the bottom portion 13 may comprise a recess towards the lid 6 in which the piercing element 9 can be inserted. The dimensions of the recess will be proportionate to those of the piercing element 9 and to the related stroke that it must cover inside the capsule 1 (the distance between the lower wall 3 and the tip of the piercing element 9, when the latter is inserted in the capsule 1). Depending if the piercing element 9 passes through the lower wall 3 centrally or off-centre, the recess will be located respectively at the centre of the bottom portion 13 or off-centre relative to the axis of extension 7, in the latter case having an extension that is advantageously annular about it. Alternatively to the presence of an annular recess, the filter 10 may have a substantially conical shape, the taper being such that it prevents contact with the piercing element 9 even when it is completely inserted (considering its maximum stroke) in the second compartment 16.

Advantageously, in the preferred embodiment, the bottom portion 13 of the filter 10 is spaced from the lower wall 3 to allow, during capsule 1 use in a system suitable for using it, insertion of the piercing element 9 in the capsule 1, through the lower wall 3, without the bottom portion 13 of the filter 10 being damaged. Moreover, the bottom portion 13 of the filter 10 preferably mainly comprises a flat disk extending in a substantially circular fashion about the axis of extension 7.

In the embodiment illustrated, the position of the counter-shoulder 18 on the coupling portion 14 and the position of the shoulder 17 on the filter 10, are established to determine a distance between the lower wall 3 of the body 2 and the bottom portion 13 of the filter 10 which is greater than the distance between the tip of the piercing element 9 and the lower wall 3 when the piercing element 9 is inserted in the capsule 1.

Again with reference to the shape of the filter 10, it is, as already indicated, in contact with the side wall 4 at the coupling portion 14. Starting from the coupling portion 14 and proceeding towards the lower wall 3, the filter 10 and the side wall 4 are separated from one another, advantageously radially with reference to the axis of extension 7, that is to say, between the side wall 4 of the body 2 and the side portion 20 of the filter 10 there is an empty space which corresponds to the part of the second compartment 16 positioned between the side wall 4 and the filter 10.

Advantageously, the distance between the filter 10 and the side wall 4 at the second compartment 16 increases proceeding towards the bottom portion 13. For example, if the side wall 4 extends in a substantially conical fashion with reference to the axis of extension 7, proceeding from the lid 6 towards the lower wall 3, the side portion 20 of the filter 10 may for example have a similar extension but with a more pronounced taper.

However, in the preferred embodiment illustrated, the side portion 20 of the filter 10 has the structure of superposed rings 21, which are concentric about the axis of extension 7 and connected to each other. Each ring 21, proceeding from the rim 12 towards the bottom portion 13 of the filter 10, delimits a respective section of the first compartment 15, in a plane substantially perpendicular to the axis of extension 7, having an area greater than that delimited by the next ring 21. Advantageously, in the embodiment illustrated, the same ring 21 delimits various sections of the first compartment 15 (which are perpendicular to the axis of extension 7) which have decreasing areas proceeding in the direction from the rim 12 towards the bottom portion 13. In other words, each ring 21, proceeding from the rim 12 towards the bottom portion 13, moves closer to the axis of extension 7. In the preferred embodiment illustrated, each section delimited by a ring 21 is substantially circular and its centre is identified by the intersection with the axis of extension 7. The ring 21 delimiting the section with the smallest area (and advantageously radius), that is to say, the ring 21 closest to the lower wall 3, surrounds the bottom portion 13.

Said structure of the side portion 20 of the filter 10 gives it rigidity and makes its production easier, which advantageously can be carried out using injection moulding.

Figure 4:
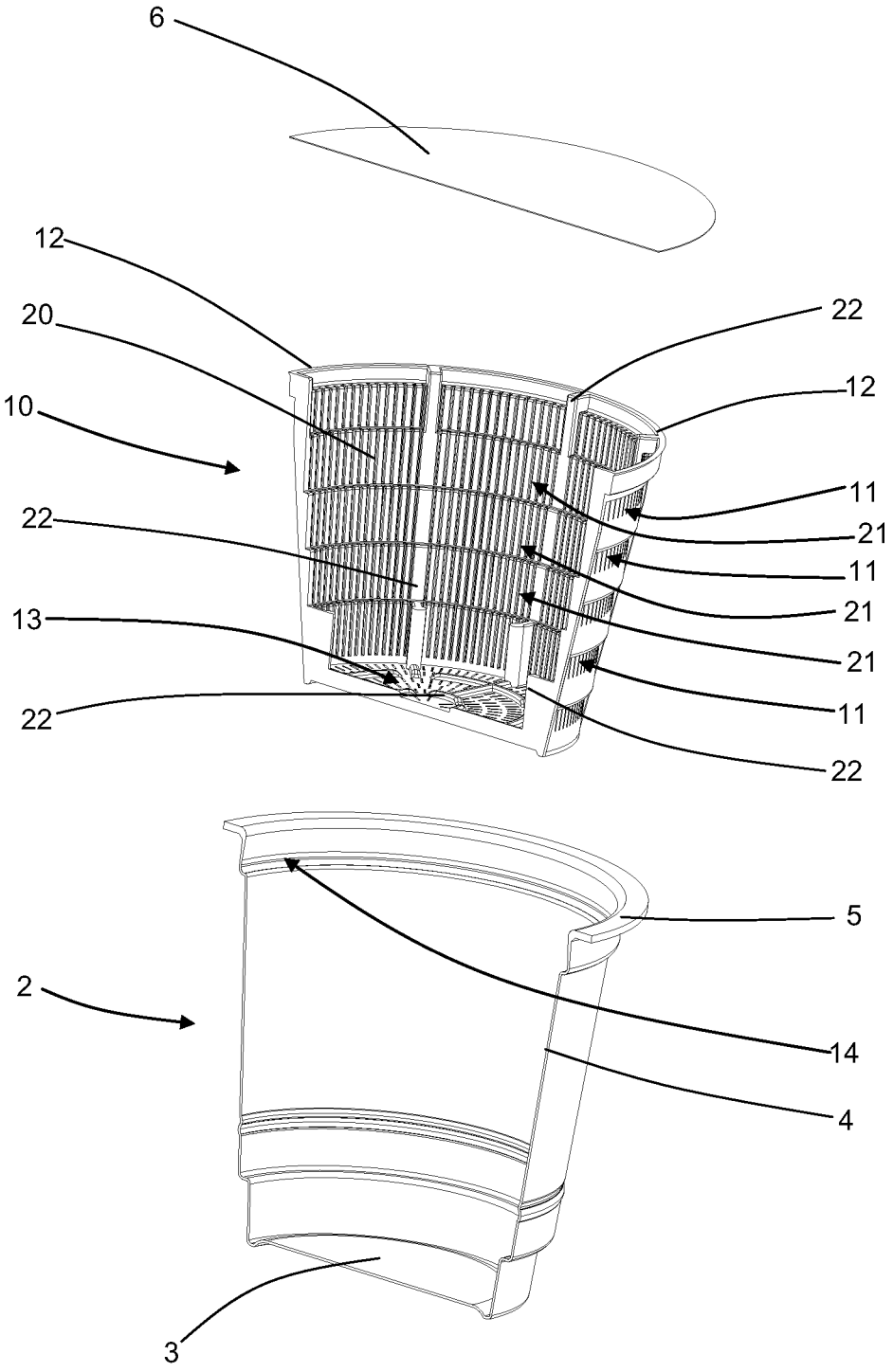
FIG. 4 is an exploded view of the capsule of FIG. 1.

The side portion 20, seen in radial section relative to the axis of extension 7, comprises, on the side facing towards the first compartment 15, a substantially stepped profile, each step corresponding to one of the rings 21. Advantageously, even the on the side facing towards the side wall 4 the side portion 20 of the filter 10 comprises a stepped profile, each step radially recessed, with reference to the axis of extension 7, relative to the adjacent step positioned between it and the rim 12. In other words, the side portion 20 of the filter 10 comprises inner steps, formed by the rings 21, and outer steps, facing towards the side wall 4. As shown in FIGS. 1, 2 and 4, advantageously, the inner steps and the outer steps are not aligned with each other. In particular, each outer step extends substantially from approximately half the height, measured parallel with the axis of extension 7, of each inner step. In other words, each inner step (or ring 21) is opposite to an outer step only at a portion of the former which advantageously extends over around half of the extension of the inner step (or ring 21) and which in the accompanying drawings corresponds to the half of each ring 21 positioned towards the rim 12. However, in other embodiments, other side portion 20 configurations and structures are possible.

The openings 11 which allow fluid communication through the filter 10, that is to say, which allow the beverage to pass from the first compartment 15 to the second compartment 16, at least mainly preventing the passage of the powdered food substance which remains confined in the first compartment 15, are, as already indicated, located at least on the portion of the filter 10 which is at the part of the second compartment 16 positioned between the filter 10 and the side wall 4 of the capsule 1 body 2. Therefore, advantageously, the openings 11 are made at the side portion 20 of the filter 10. In the preferred embodiment illustrated, there are several openings 11 on each of the rings 21. In the embodiment illustrated, in particular, the openings 11 are formed by slits extending mainly parallel with the axis of extension 7, being arranged side by side. As shown in the accompanying drawings, the slits extend substantially over the entire height of each ring 21 (and therefore of each inner step). However, only the part of each slit extending on the portion of inner step (or ring 21) not opposite to an outer step forms an opening 11.

As already indicated, the openings 11 are advantageously also made in the bottom portion 13 (which mainly has the shape of a flat disk). In the embodiment illustrated, said openings 11 are elongate slots extending on the bottom portion 13 in directions which are radial relative to the axis of extension 7.

However, more generally, whatever the shape of the filter 10 and wherever the openings 11 are positioned, they may have a different shape, orientation, arrangement and dimensions, for example, they may be circular holes, or cross-shaped, elongate slits, curves, etc. Moreover, the filter 10 may comprise different types of openings 11.

In the preferred embodiment the filter 10 also comprises stiffening ribs 22 which, advantageously, are at least located on the side portion 20 of the filter 10. As shown in the accompanying drawings, advantageously, the ribs 22 of the side portion 20 extend longitudinally from the rim 12 at least to the bottom portion 13 and lie substantially in planes passing through the axis of extension 7. Preferably, the ribs 22 also extend on the bottom portion 13. In the preferred embodiment illustrated, more precisely, some ribs 22 extend over radial stretches (with reference to the axis of extension 7) on the bottom portion 13 whilst other ribs 22 extend over annular stretches about the axis of extension 7. The ribs 22 with annular extension and radial extension may meet one another, as shown in FIGS. 1 and 4. Some ribs 22 of the bottom portion 13 which extend radially may also extend from the ribs 22 of the side portion 20.

In the embodiment illustrated, the ribs 22 of the side portion 20 extend on the rings 21 and on the outer steps in which the side portion 20 is structured and they project radially relative to the latter, creating an overall frusto-conical shape: in other words, each rib 22 is angled in such a way that, proceeding from the rim 12 towards the bottom portion 13 of the filter 10, the distance between its outer surface and the capsule 1 axis of extension 7 is reduced, and therefore, in the preferred embodiment, the distance between it and the side wall 4 is increased.

In the preferred embodiment the ribs 22 do not make contact with the capsule 1 body 2, except at the coupling portion 14. However, in general the filter 10 may be in contact with the capsule 1 body 2 even at various points other than the coupling portion 14, provided that there is no interruption in the fluid communication both through the filter 10 and with the beverage outfeed zone through the lower wall 3. Therefore, in some embodiments, one or more of the ribs 22 present on the side portion 20 and/or on the bottom portion 13 may be in contact with the capsule 1 body 2: for example the longitudinal ribs 22 present on the side portion 20 could be in contact at one or more points with the side wall 4 located between the coupling portion 14 and the lower wall 3, whilst between one rib 22 and another the filter 10 is distanced from the side wall 4.

As indicated, the capsule 1 is suitable for use in a beverage making system based on capsules which comprises water injecting means that can be associated with the capsule 1 lid 6 and beverage extracting means which can be associated with the lower wall 3 of the capsule 1. In particular, in the preferred embodiment, an injecting element 8 which pierces the lid 6 is used to inject the water into the first compartment 15 which contains the powdered food substance. The water interacts with the powdered food substance, making the beverage which, driven by the water flow (which may be pressurised), passes through the powder, covering stretches of it until it reaches the openings 11 present in the filter 10. While the powdered food substance at least mainly remains confined in the first compartment 15, the beverage passes through the openings 11 from the first compartment 15 to the second compartment 16, where it can come out of the capsule 1 after the action of the piercing element 9 which penetrates the lower wall 3. Depending on the type of beverage making system, the beverage may come out through the hole left by the piercing element 9 or through a channel present in said element.

This invention brings important advantages.

The presence of the openings in the surface of the filter located at the portion of the second compartment positioned between the filter and the side wall of the capsule body allows a reduction in the average distance that the water must cover through the powdered food substance in order to be able to come out of the filter. For example, the beverage made close to the lid is not forced to pass through substantially all of the powdered food substance in order to be able to come out through the bottom portion of the filter, but can come out through the above-mentioned openings closest to it. In that way, the beverage encounters less resistance during its movement. Moreover, in that way, the risk of the formation of highly compacted areas linked to the substantially unidirectional flow of water and beverage is reduced. In this way, while the beverage is being made the powdered food substance maintains substantially even compactness, consequently reducing the risk of the formation of preferential water flow channels, and the water can therefore permeate the food substance more evenly and homogeneously, leading to an increase in the quality of the beverage made.

Added to that is the fact that the filter of the capsule which is the subject of this invention, thanks to its shape and the presence of the above-mentioned openings, comprises a filtering surface greater than that of a common flat filter (the dimensions of the capsule being the same), while keeping the quantity of powdered food substance contained in it substantially unchanged. That allows improved filtering of the beverage.

Finally, it should be noticed that this invention is relatively easy to produce and that even the cost linked to implementing the invention is not very high.

The invention described above may be modified and adapted in several ways without thereby departing from the scope of the inventive concept.

Moreover, all details of the invention may be substituted with other technically equivalent elements and the materials used, as well as the shapes and dimensions of the various components, may vary according to requirements.

The invention claimed is:

1. A capsule for making beverages comprising at least one powdered food substance which can be extracted by passing water through it to make a beverage, comprising:

a substantially cup-shaped body which in turn comprises a lower wall and a side wall;

a lid fixed to the body at an edge of the side wall located on the opposite side to the lower wall, between the lid and the inner surface of the body there also being a chamber and between a central point of the lid and a central point of the lower wall being identified a capsule axis of extension;

a rigid or semi-rigid filter positioned in the chamber and coupled to the capsule body at a coupling portion which is substantially annular about the axis of extension and located on the side wall, said filter comprising openings to allow fluid communication through it;

characterised in that the filter extends between a substantially annular rim located at the top of the filter and positioned close to the capsule lid, and a bottom portion located at the bottom of the filter and positioned close to the lower wall, the coupling portion being located close to the edge of the side wall and the filter being coupled to the coupling portion substantially at the rim;

and in that the filter substantially separates the chamber into a first compartment in which the powered food substance is contained and a second compartment, said first compartment being delimited at least between the filter and the lid, and said second compartment being delimited between the filter, the lower wall and the portion of the side wall located between the lower wall and the coupling portion, at least part of the second compartment being positioned between the side wall and the filter and the second compartment extending along the side wall to the coupling portion and at least over most of the distance between the coupling portion and the lower wall measured parallel with the axis of extension, said openings being made at least at the part of the second compartment positioned between the filter and the side wall, the filter is substantially cup-shaped and includes a side portion extending between the bottom portion and the rim about the axis of extension, said openings being located at least on the side portion, the distance between the filter and the side wall at the second compartment increases proceeding towards the bottom portion, and the side portion of the filter has the structure of superposed rings, which are annular about the axis of extension and are connected to each other, each of the rings, proceeding from the rim towards the bottom portion of the filter, delimiting a respective section of the first compartment, in a plane substantially perpendicular to the axis of extension, having an area greater than that delimited by the next ring, the side portion, seen in radial section relative to the axis of extension, comprising, on the side facing towards the first compartment, a profile substantially formed by steps corresponding to said rings.

2. The capsule according to claim 1, characterised in that the filter is coupled to the coupling portion by mechanical interference.

3. The capsule according to claim 1, characterised in that the filter is coupled to the coupling portion by creating a sealed contact with it.

4. The capsule according to claim 1, characterised in that, close to the rim, the filter comprises a shoulder which is substantially annular about the axis of extension and which projects radially relative to the rest of the filter with reference to the axis of extension, and in that the coupling portion comprises a counter-shoulder which is substantially annular about the axis of extension and also projects radially, with reference to the axis of extension, relative to the portion of side wall adjacent to it on the lower wall side, said shoulder resting on the counter-shoulder and said rim being coupled to an annular region of the coupling portion located between the counter-shoulder and the edge.

5. The capsule according to claim 4, characterised in that the filter is coupled to the coupling portion by mechanical interference and in that the coupling by mechanical interference is created between the rim of the filter and the annular region of the coupling portion.

6. The capsule according to claim 4, characterised in that the filter is coupled to the coupling portion by creating a sealed contact with it and in that the sealed contact is created between the rim of the filter and the annular region of the coupling portion.

7. The capsule according to claim 1, characterised in that the bottom portion of the filter is spaced from the lower wall to allow, during use, insertion of a piercing element in the capsule, through the lower wall, without the bottom portion of the filter being damaged.

8. The capsule according to claim 1, characterised in that there are several of said openings located on each of the rings.

9. The capsule according to claim 1, characterised in that the bottom portion of the filter mainly comprises a flat disk extending in a substantially circular fashion about the axis of extension.

10. The capsule according to claim 1, characterised in that the filter comprises stiffening ribs.

11. The capsule according to claim 10, characterised in that the ribs are at least located on the side portion of the filter, said ribs extending longitudinally from the rim at least to the bottom portion and substantially lying in planes passing through the axis of extension.

12. The capsule according to claim 1, characterised in that the lower wall can be pierced during use to allow the beverage to come out of the capsule, and also being characterised in that, during use, a piercing element can be inserted in the second compartment, without damaging the filter, following penetration through the lower wall.

13. The capsule according to claim 1, characterised in that the lower wall can be pierced during use to allow the beverage to come out of the capsule, and also being characterised in that, during use, a piercing element can be inserted in the second compartment, without damaging the filter, following penetration through the lower wall.

14. A capsule for making beverages comprising at least one powdered food substance which can be extracted by passing water through it to make a beverage, comprising:

a substantially cup-shaped body which in turn comprises a lower wall and a side wall;

a lid fixed to the body at an edge of the side wall located on the opposite side to the lower wall, between the lid and the inner surface of the body there also being a chamber and between a central point of the lid and a central point of the lower wall being identified a capsule axis of extension;

a rigid or semi-rigid filter positioned in the chamber and coupled to the capsule body at a coupling portion which is substantially annular about the axis of extension and located on the side wall, said filter comprising openings to allow fluid communication through it;

characterised in that the filter extends between a substantially annular rim located at the top of the filter and positioned close to the capsule lid, and a bottom portion located at the bottom of the filter and positioned close to the lower wall, the coupling portion being located close to the edge of the side wall and the filter being coupled to the coupling portion substantially at the rim;

and in that the filter substantially separates the chamber into a first compartment in which the powered food substance is contained and a second compartment, said first compartment being delimited at least between the filter and the lid, and said second compartment being delimited between the filter, the lower wall and the portion of the side wall located between the lower wall and the coupling portion, at least part of the second compartment being positioned between the side wall and the filter and the second compartment extending along the side wall at least over most of the distance between the coupling portion and the lower wall measured parallel with the axis of extension, said openings being made at least at the part of the second compartment positioned between the filter and the side wall, characterised in that the filter is substantially cup-shaped and comprises a side portion extending between the bottom portion and the rim about the axis of extension, said openings being located at least on the side portion, and characterised in that the distance between the filter and the side wall at the second compartment increases proceeding towards the bottom portion and in that the side portion of the filter has the structure of superposed rings, which are annular about the axis of extension and are connected to each other, each of the rings, proceeding from the rim towards the bottom portion of the filter, delimiting a respective section of the first compartment, in a plane substantially perpendicular to the axis of extension, having an area greater than that delimited by the next ring, the side portion, seen in radial section relative to the axis of extension, comprising, on the side facing towards the first compartment, a profile substantially formed by steps corresponding to said rings.

15. The capsule according to claim 14, characterised in that there are several of said openings located on each of the rings.

16. The capsule according to claim 14, characterised in that the lower wall can be pierced during use to allow the beverage to come out of the capsule, and also being characterised in that, during use, a piercing element can be inserted in the second compartment, without damaging the filter, following penetration through the lower wall.

17. A capsule for making beverages comprising at least one powdered food substance which can be extracted by passing water through it to make a beverage, comprising:

a substantially cup-shaped body which in turn comprises a lower wall and a side wall;

a lid fixed to the body at an edge of the side wall located on the opposite side to the lower wall, between the lid and the inner surface of the body there also being a chamber and between a central point of the lid and a central point of the lower wall being identified a capsule axis of extension;

a rigid or semi-rigid filter positioned in the chamber and coupled to the capsule body at a coupling portion which is substantially annular about the axis of extension and located on the side wall, said filter comprising openings to allow fluid communication through it;

characterised in that the filter extends between a substantially annular rim located at the top of the filter and positioned close to the capsule lid, and a bottom portion located at the bottom of the filter and positioned close to the lower wall, the coupling portion being located close to the edge of the side wall and the filter being coupled to the coupling portion substantially at the rim;

and in that the filter substantially separates the chamber into a first compartment in which the powered food substance is contained and a second compartment, said first compartment being delimited at least between the filter and the lid, and said second compartment being delimited between the filter, the lower wall and the portion of the side wall located between the lower wall and the coupling portion, at least part of the second compartment being positioned between the side wall and the filter and the second compartment extending along the side wall at least over most of the distance between the coupling portion and the lower wall measured parallel with the axis of extension, said openings being made at least at the part of the second compartment positioned between the filter and the side wall, close to the rim, the filter comprises a shoulder which is substantially annular about the axis of extension and which projects radially relative to the rest of the filter with reference to the axis of extension, and in that the coupling portion comprises a counter-shoulder which is substantially annular about the axis of extension and also projects radially, with reference to the axis of extension, relative to the portion of side wall adjacent to it on the lower wall side, said shoulder resting on the counter-shoulder and said rim being coupled to an annular region of the coupling portion located between the counter-shoulder and the edge, the filter is substantially cup-shaped and comprises a side portion extending between the bottom portion and the rim about the axis of extension, said openings being located at least on the side portion, and the distance between the filter and the side wall at the second compartment increases proceeding towards the bottom portion and in that the side portion of the filter has the structure of superposed rings, which are annular about the axis of extension and are connected to each other, each of the rings, proceeding from the rim towards the bottom portion of the filter, delimiting a respective section of the first compartment, in a plane substantially perpendicular to the axis of extension, having an area greater than that delimited by the next ring, the side portion, seen in radial section relative to the axis of extension, comprising, on the side facing towards the first compartment, a profile substantially formed by steps corresponding to said rings.

18. The capsule according to claim 17, characterised in that there are several of said openings located on each of the rings.

19. The capsule according to claim 17, characterised in that the lower wall can be pierced during use to allow the beverage to come out of the capsule, and also being characterised in that, during use, a piercing element can be inserted in the second compartment, without damaging the filter, following penetration through the lower wall.

* * * * *